US006520693B2

(12) United States Patent
Lobo et al.

(10) Patent No.: US 6,520,693 B2
(45) Date of Patent: Feb. 18, 2003

(54) METHOD OF PROVIDING PHOTOPROCESSING SERVICES

(75) Inventors: Lloyd A. Lobo, Webster, NY (US); Jeffrey L. Hall, Rochester, NY (US); Robert B. Call, Rochester, NY (US); Jay E. Mathewson, North Chili, NY (US); Donna M. Timmons, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/823,076

(22) Filed: Mar. 30, 2001

(65) Prior Publication Data

US 2002/0141758 A1 Oct. 3, 2002

(51) Int. Cl.[7] ..... G03D 3/02

(52) U.S. Cl. ..... 396/564; 396/626; 206/524.2; 430/450; 430/490; 220/495.01; 428/34.4; 428/36.6

(58) Field of Search ..... 396/567, 599, 396/626; 222/83, 85, 86; 220/495.01; 206/524.2, 524.9, 526; 430/450, 467, 490, 492, 493; 428/34.4, 35.4, 36.6, 36.7

(56) References Cited

U.S. PATENT DOCUMENTS

| | | | | |
|---|---|---|---|---|
| 3,687,050 A | | 8/1972 | Wilke | |
| 3,978,506 A | | 8/1976 | Geyken et al. | |
| 4,171,716 A | | 10/1979 | Szabo et al. | |
| 4,197,942 A | | 4/1980 | Gacki et al. | |
| 4,533,225 A | | 8/1985 | Siga | 396/626 |
| 4,577,951 A | * | 3/1986 | Takahashi et al. | 396/622 |
| 4,791,013 A | | 12/1988 | Koboshi et al. | |
| 4,814,809 A | | 3/1989 | DePrijcker et al. | |
| 4,958,666 A | | 9/1990 | Kocourek et al. | |
| 5,199,594 A | | 4/1993 | Obara et al. | |
| 5,288,728 A | | 2/1994 | Spears et al. | |
| 5,384,233 A | | 1/1995 | Kuse et al. | |

(List continued on next page.)

FOREIGN PATENT DOCUMENTS

| | | |
|---|---|---|
| EP | 0 500 371 A2 | 2/1992 |
| EP | 0 727 709 A1 | 8/1996 |

OTHER PUBLICATIONS

Method for supplying processing liquid and removing waste for photographic processing machine, by Janssen et al., Apr. 10, 1998, Derwent InformationLtd., 8 pages, basic abstract.*

*Primary Examiner*—D. Rutledge
(74) *Attorney, Agent, or Firm*—David A. Novais

(57) ABSTRACT

A method of providing photoprocessing services utilizes a packaging system in which photoprocessing solutions are distributed from a source of manufacture to a photofinishing site. The packaging system includes a rigid or semi-rigid outer container and at least one internal container. The internal container includes the processing solution, and can be made of a rigid or flexible material. The internal container may be separable from the outer container or may be in the form of an internal compartment that is integral with the outer container. As an option, the outer container can house a further container that is designed to collect waste or spent solution from the photoprocessing site. With the system of the present invention, a designated supplier entity can follow the packaging system through an entire usage cycle of the system.

38 Claims, 4 Drawing Sheets

U.S. PATENT DOCUMENTS

| | | | |
|---|---|---|---|
| 5,398,093 | A | 3/1995 | Carozzi |
| 5,496,474 | A | 3/1996 | Christ, Jr. et al. |
| 5,503,751 | A | 4/1996 | Glover et al. |
| 5,526,087 | A | 6/1996 | Suzuki et al. |
| 5,532,780 | A | 7/1996 | Fyson |
| 5,561,488 | A | 10/1996 | Fyson |
| 5,577,614 | A | 11/1996 | Palmeroni, Jr. et al. |
| 5,675,792 | A | 10/1997 | Earle et al. |
| 5,690,817 | A | 11/1997 | Glover et al. |
| 5,694,991 | A | 12/1997 | Harris et al. |
| 5,720,383 | A | 2/1998 | Glover |
| 5,752,124 | A | 5/1998 | Glover et al. |
| 5,759,410 | A | 6/1998 | Christ, Jr. et al. |
| 5,778,272 | A | 7/1998 | Rosenburgh et al. |
| 5,778,274 | A | 7/1998 | Foster et al. |
| 5,882,593 | A | 3/1999 | Fyson |
| 5,996,653 | A | 12/1999 | Piccinino, Jr. |
| 6,040,776 | A | 3/2000 | Glover et al. |
| 6,058,954 | A | 5/2000 | Glover et al. |

* cited by examiner

METHOD OF PROVIDING PHOTOPROCESSING SERVICES

CROSS REFERENCE TO RELATED APPLICATIONS

Reference is made to commonly assigned copending application Ser. No. 09/822,963 filed Mar. 30, 2001, entitled A PHOTOFINISHING PROCESSING SYSTEM AND A PROCESSING SOLUTION SUPPLY CARTRIDGE FOR THE PROCESSING SYSTEM, filed concurrently herewith in the names of Robert Call, Jay Mathewson, Donna Timmons and Richard Horn.

FIELD OF THE INVENTION

The present invention relates to a method of providing photoprocessing services and more specifically, a method of distributing photoprocessing solutions from a source of manufacture to a photofinishing site, utilizing a packaging system that can be reused several times, until damage or wear causes its physical integrity to render it unusable.

BACKGROUND OF THE INVENTION

Over the past few years photoprocessing services have directed a greater number of customers towards processing machines that utilize chemical supply cartridges as the means of chemical delivery. These chemical supply cartridges provide the assortment of chemistry solutions (developers, fixers, bleaches, etc.) which are used to process the particular photographic material. Typically, these solutions are provided in concentrated form and are combined with water as they are added into the photoprocessing system. Currently, these photochemical solutions are delivered by packages which are not reused. The cost of these packages, are typically high and often come close to or exceed the cost of the actual chemical solution they are supplying. Therefore, there is a need for a system and method of providing photoprocessing services which allows for part of the packaging or the total packaging to be reused several times. Such a method and system would minimize the amount of packaging waste generated and provide cost benefits.

In most current operations, chemical supplies are provided by using a bag-in-a-box containers or as containers of concentrates. While the bag-in-a-box containers provide for an adequate mechanism for transport and quality of the solution, they generate a great deal of packaging waste and may not be an optimal design for preventing unwanted chemical leaks during transport and use. The packaging waste includes a financial cost in that this one-use packaging significantly contributes to the overall cost of the photofinishing chemicals. The waste also includes a negative environmental impact in that this one-use packaging is disposed of after each use. In using these bag-in-box containers, photofinishers need to take an additional step of disposal of the packaging material, and if residual amounts of photofinishing solutions are present after emptying the containers, these chemicals can limit the disposal methods. As regional regulations become more stringent, it becomes more difficult for the end user to dispose of the used packaging material. Therefore, there is presently a need for a packaging system or assembly where the packaging is designed to be reusable, so that the emptied containers can be shipped back to a distributor, who can then clean out the containers appropriately and refill them for subsequent use. There is further a need for a chemical management cartridge that both provides the complete chemical needs of the photoprocessor chemical solutions and then collects all the spent photochemistry. For such a self-contained packaging system, the processing system requires no attachment to water supplies and can be adapted to require no access to drains. By eliminating the need of this infrastructure, the photoprocessing machines can exist in underserved marketplaces such as airplanes, cruise ships and mobile booths.

U.S. Pat. No. 5,675,792 discloses the use of a single reusable container. However, this arrangement has several drawbacks. First, if the processing system being supplied with solution requires more than one type of solution, additional containers are needed to interface with the processing system. Second, the stresses involved in transporting the container can cause cracks, leaks, etc., which would make a single container system without secondary containment a hazard risk. Third, the chemicals that need to be transported, (particularly the developer) may have certain constraints with packaging material selection, and the constraints of compatibility and transportability may narrow the selection of the container materials. Finally, U.S. Pat. No. 5,675,792 does not suggest a system or method of providing photoprocessing services.

In the prior art, there remains a need for a method in which a service provider essentially follows the usage cycle of the container, by supplying a cartridge to a photoprocessing site, recovering the spent cartridge, and refurbishing the spent cartridge for reuse. Economic, service and environmental advantages exist when a single service provider provides, recollects, and refurbishes, and then ultimately disposes of the photographic chemical supply cartridge.

SUMMARY OF THE INVENTION

The present invention provides a method of providing photofinishing services in which a supply entity, such as a single supplier or an association of suppliers, can provide chemistry, remove spent or waste solution, and refit/refurbish a chemical supply cartridge that is used in a photofinishing operation. The method can be done by a total service provider who follows a supply cartridge through its entire usage cycle. Therefore, the present invention provides for a method of distributing photoprocessing solutions from its source of manufacture to a photofinishing site, using a packaging system that can be reused several times, until physical integrity renders it unusable.

The packaging system can be used to deliver solutions that are concentrated or supplied at their working strength. Furthermore, the method of the present invention can be used to deliver all of the solutions or only certain solutions that are critical to the quality of the photofinishing operations. An advantage of this kind of service is that a processing machine can have a stand-alone (without access to drains and water) ability, while the servicing of the processing machine as well as the packaging required to supply chemistry and capture waste is minimized.

The present invention accordingly relates to a method of providing photoprocessing services which comprises the steps of (a) filling at least one internal container with a processing solution; (b) placing the at least one internal container having the processing solution therein into an outer container; (c) transporting the outer container having the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied; (d) removing the outer container having the at least one empty internal container therein from the processing machine; and (e) preparing at least one of the internal and outer containers for reuse. In the method of the present invention, each of the steps (a) to (e) are performed by a designated supplier entity.

Within the context of the present invention, a designated supplier entity can refer to a single supplier that offers to supply the total photochemical needs and other associated processing services, or an association of suppliers that offer the designated services noted above.

The present invention further provides for a method of providing photoprocessing services which comprises filling at least one internal container with a processing solution; placing a waste container and the at least one internal container having a processing solution therein into an outer container; transporting the outer container having the waste container and the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied and waste processing solution from the processing machine is collected in the waste container; removing the outer container containing the waste container filled with waste solution and the at least one empty internal container therein from the processing machine; and later refurbishing and reusing at least the outer container.

The present invention further relates to a method of providing photoprocessing services which comprises (a) filling at least one internal compartment of a container with a processing solution, with the at least one internal compartment being integral with the container, (b) transporting the container having the at least one filled internal compartment to a processing site for use at the processing site, wherein during use, the container with the at least one filled internal compartment is fluidly connected to a processing machine at the processing site, such that the processing solution is supplied from the at least one filled internal compartment to a processing machine until the at least one internal compartment is emptied; (c) removing the container having the at least one emptied internal compartment from the processing machine; and (d) refurbishing the container and the internal compartment. In the method noted above, the steps (a) to (d) are performed by a designated supplier entity.

The present invention further relates to a method of providing photoprocessing services which comprises filling a first internal compartment of a container with a processing solution, with the container having a second internal compartment for waste solution, and the first and second internal compartments being integral with the container; transporting the container having the filled first internal compartment and the second internal compartment for waste solution to a processing site for use at the processing site, wherein during use, the container is fluidly connected with a processing machine at the processing site, such that the processing solution is supplied from the first filled internal compartment to the processing machine until the first filled internal compartment is emptied, and waste solution from the processing machine is continuously or periodically collected in the second internal compartment for waste solution; removing the container having the emptied first internal compartment and the second internal compartment filled with waste processing solution therein from the processing machine; and refurbishing or preparing the container and the first and second internal compartments for reuse.

The present invention further relates to a method of providing photofinishing services wherein a single service supplier performs the steps of supplying a processing solution packaging system having processing solution therein to a photofinishing site for use in a processor at the photofinishing site; removing the processing solution packaging system and waste processing solution resulting from the use of the processing packaging system from the photofinishing site; and refurbishing the processing solution packaging system for reuse at the photofinishing site or at a further photofinishing site.

The present invention further relates to a photoprocessing method which comprises filling at least one internal container with a processing solution; placing the at least one internal container having the processing solution therein into an outer container; transporting the outer container having the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied; removing the outer container having the at least one emptied internal container therein from the processing machine; and reusing at least the outer container.

The present invention further relates to a method of providing photoprocessing services, wherein a single service supplier performs the steps of: supplying a processing solution packaging system having processing solution therein to a photofinishing site for use in a processor at the photofinishing site, with the packaging system comprising at least two rigid outer containers each having at least one internal container filled with processing solution therein, wherein an amount of solution in each of the internal containers is such that the solutions in the internal containers will be completely utilized during use in the processor, and wherein at least one of the rigid containers has a further internal container for receiving waste processing solution; removing the processing solution packaging system and waste processing solution resulting from the use of the processing solution packaging system from the photofinishing site; and refurbishing the processing solution packaging system for reuse at the photofinishing site or at a further photofinishing site.

The present invention further relates to a reusable processing solution packaging system which comprises at least two rigid outer containers, each one of the at least two rigid outer containers having at least one internal container filled with processing solution therein, wherein an amount of solution in each of the internal containers is such that the solutions in the internal containers will be completely utilized during use in a processor.

In a feature of the invention, the packaging system can be designed to contain the entire volume of photoprocessing solutions (no additional water supply needed) and collect the entire liquid waste generated. The method of the present invention eliminates any need for the photofinishing operator to dispose of any waste (packaging or photofinishing). In another feature of the present invention, the waste collection that is integral to the supply packaging system includes a methodology which reduces the concentration of leachable silver in the spent solution with respect to the silver TCLP (Toxicity Characteristics Leaching Procedure) test for non-hazardous waste based on U.S. Resource Conservation and Recovery Act (RCRA) definitions, so that the customer realizes waste management advantages. Advantages with this classification include reduced record keeping and training, and increased financial incentives. This eliminates the need for the photofinisher to either have a separate treatment operation or to ship as hazardous waste.

DETAILED DESCRIPTION OF THE INVENTION

Figure 1A:
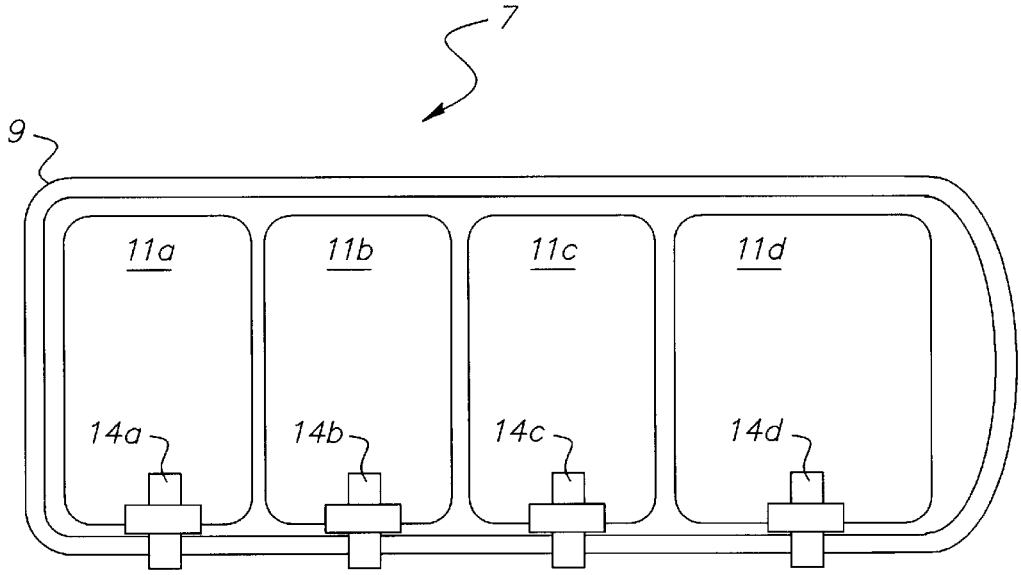
FIG. 1A illustrates an embodiment of a packaging system or a supply cartridge in accordance with the present invention.
Figure 1B:
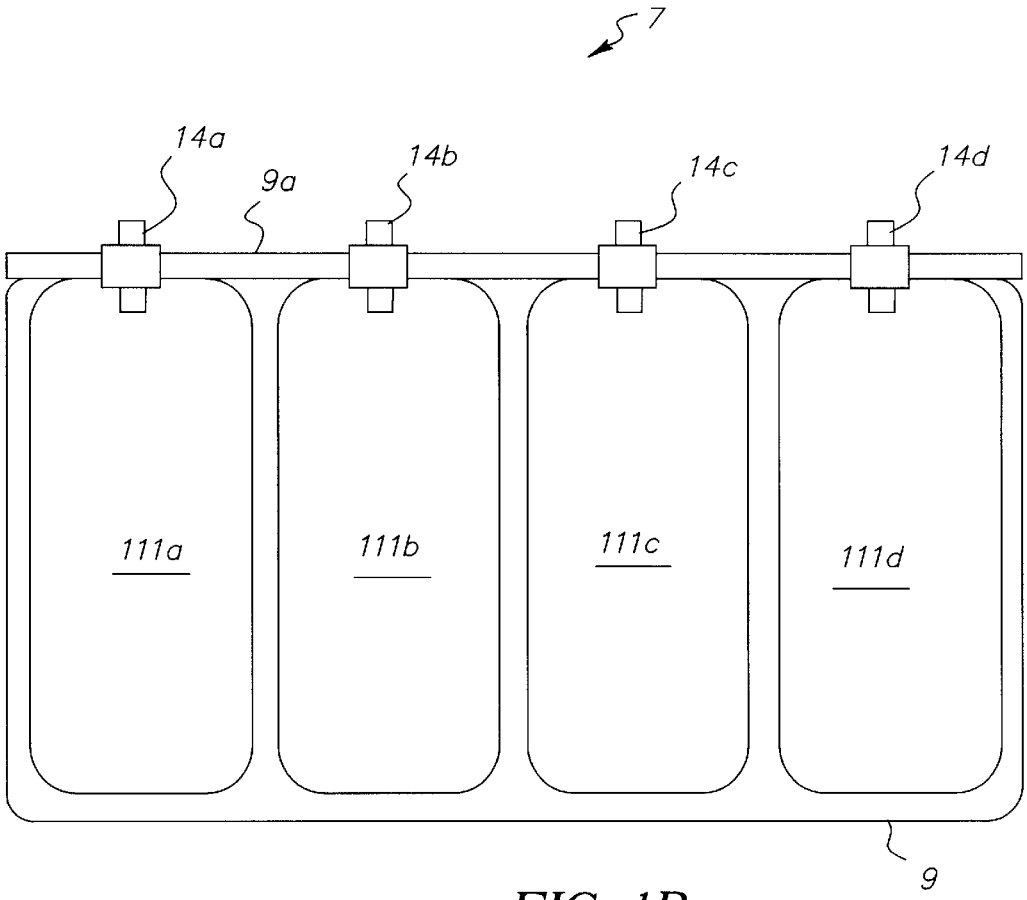
FIG. 1B illustrates an embodiment of a packaging system which includes a container with integral compartments.

Referring now to the drawings, wherein like reference numerals represent identical or corresponding parts throughout the several views, the present invention provides for a system or method of supplying photoprocessing services which involves supplying photoprocessing chemical solutions in a manner in which the packaging material that contains the solutions can be reused. As shown in FIG. 1A, a packaging system, assembly or cartridge 7 includes an outer container 9 and at least one internal container or chamber (11*a*–11*d*). Outer container 9 is one that has some rigidity so it can be transported, while the at least one internal container, compartment or chamber 11*a*–11*d* contains the appropriate processing solution. Outer container 9 further acts as a secondary container in case one of the internal containers leaks. Internal containers 11*a*–11*d* can be rigid or flexible and may or may not be physically distinct from outer container 9. More specifically, rather than being in the form of internal containers 11*a*–11*d* which are removable from outer container 9, internal containers 11*a*–11*d* can be in the form of internal compartments or containers which are integral with outer container 9 as shown in FIG. 1B. More specifically as shown in FIG. 1B, rigid outer shell 9 of system 7 could be in the form of a molded shell having integral cavities or compartments 111*a*, 111*b*, 111*c*, 111*d* which contain the appropriate processing solution. Rigid outer shell 9 as shown further includes a sealing lid 900*a*. Therefore, in the present invention, either a removable internal container, compartment, or chamber, or an integral internal container, compartment or chamber can be used.

Referring back to FIG. 1A, internal containers 11*a*–11*d* can further be flexible pouches or rigid containers that are separate but can be housed within outer container 9. Although the example of FIG. 1A illustrates an outer container 9 having 4 internal containers, the number of internal containers, compartments or chambers utilized is based on design considerations and the processing cycle desired. Thus, outer container 9 may contain 1 or more internal containers 11*a*–11*d* (or 111*a*–111*d*) for one or more processing solutions. Packaging system 7 may be used to supply the entire system of photoprocessing solutions or selected solutions.

Figure 2:
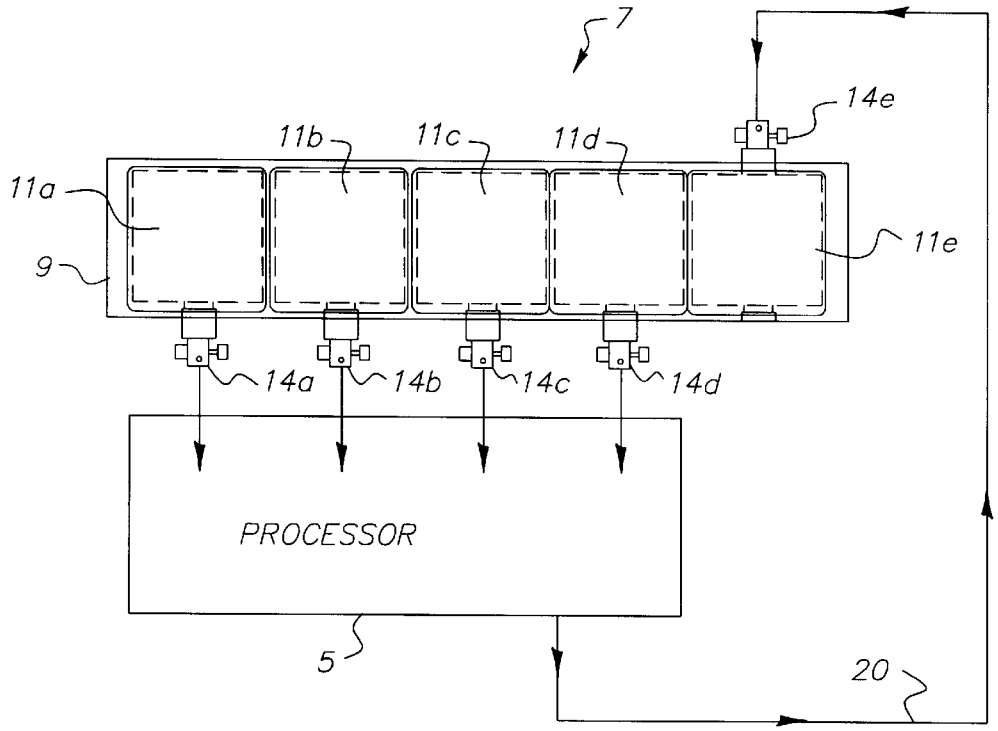
FIG. 2 shows the packaging system or supply cartridge in fluid communication with a processor.

In addition to photoprocessing solutions, outer container 9 can also house a further internal container that is designed to collect some or all of the waste or spent solution from the photoprocessing operations. Within the context of the present invention, the term waste or spent solution refers to processing or cleaning solution that has gone through a processing cycle and is no longer resident in the processor or processing equipment. This feature is illustrated in detail in FIG. 2 which also illustrates the fluid connection between packaging system 7 and a processor 5. More specifically, as illustrated in FIG. 2, packaging system 7 includes an additional removable container 11*e* which is designed to receive waste or spent solution from processor 5. For an integral arrangement, container 11*e* would be in the form of an internal compartment that is integral with outer container 9. Further, container 11*e* may or may not contain materials that treat the waste appropriately for the purpose of recovering valuable materials such as silver or rendering the materials less hazardous.

Referring to the system of FIG. 2, as well as FIGS. 1A and 1B, as an example, packaging system 7 can include valves 14*a*, 14*b*, 14*c* and 14*d* which can be either internal or external to rigid outer shell 9, and can be quick release valves or release fittings for fluidly connecting packaging system 7 to processor 5 in a known manner. Valves 14*a*–14*d* are respectively associated with containers 11*a*–11*d* or compartments 111*a*–111*d*. A valve 14*e* for spent or waste solution is associated with container 11*e*.

As an example, container 11*a* can hold and/or supply developer to processor 5; container 11*b* can hold and/or supply fresh bleach solution to processor 5; container 11*c* can hold and/or supply fixer solution to processor 5; and container 11*d* can hold and/or supply a final rinse or cleaning solution to processor 5. Processor 5 can be a known processor having individual processing tanks, areas or sections, such that a photosensitive media passes through the appropriate sections for processing in a known manner. The system as illustrated in FIG. 2 can further include a line 20 which extends from processor 5 to container 11*e*. Therefore, during use, packaging system 7 supplies fresh photographic processing solution or chemistry (or can transfer a concentrated mixture depending on the type of processing cycle and the processor) to processor 5. During use, fresh processing solutions or cleaning solutions are supplied from selected containers 11*a*–11*d* via valves 14*a*–14*d*. After processing, spent processing solution or cleaning solution is circulated via for example, conduit or line 20 to valve 14*e* of container 11*e*. In an embodiment of the invention, each of the internal containers can be filled with the appropriate amount of solution such that the solutions in the internal containers will be completely utilized during use in a processor.

As indicated above, waste container 11*e* may or may not contain materials that treat the spent solution, for the purposes of recovering valuable materials such as silver or for rendering the materials less hazardous. Several methods of silver recovery may be employed within the waste container. These include materials used in the metallic exchange, wherein such metals as iron, zinc or aluminum, in the form of powders or chopped metal fibers may be introduced into the waste containers. Ion exchange material and/or resin or TMT (Trisodium salt of 2,3,6-Trimercapto-S-Triazine) are other kinds of materials that can be placed within the waste container for the purposes of converting the silver from the soluble form to the insoluble form. In an embodiment where container 11*e* includes a silver removal device, the silver removal device can be in the form of, for example, a device that utilizes one of several known silver recovery techniques, such as but not limited to, metallic replacement technologies, iron exchange resin or TMT. The use of a silver removal chamber integrated with a chemical supply cartridge system or packaging system is described in detail in copending application Ser. No. 09/822,963 filed on Mar. 30, 2001. A chemical supply cartridge or packaging system as described in the above noted co-pending application permits the use of a cartridge having an integrated chemical supply system and spent solution removal system. In such an arrangement, after the spent solution is collected in the spent solution container, it can be treated to reduce the amount of silver within the spent solution, and accordingly provide for a spent processing solution or used cleaning solution that is less hazardous and can be disposed of in a non-regulated or less regulated manner based on existing U.S. Federal Standards.

The selection of the type of material used to make the internal and outer containers (11*a*–11*e*; 9) has several criteria. Outer container 9 has to be made durable to withstand the stresses of transport, and also has to be able to be used more than once. Outer container 9 should also be able to contain all the solutions within internal containers 11*a*–11*d*, should the internal containers develop leaks (i.e., the outer container should not dissolve or disintegrate upon contact with the solutions). Internal containers 11*a*–11*d* and 11*e* need to be made compatible with the respective solutions they hold. In case internal containers 11*a*–11*d* and 11*e* are to be used more than once, their shape has to be such that they can be cleaned and dried easily. Depending on the solution they carry, they may have some functional specifications. For example, in certain color developer solutions, the internal container material should have a low permeability to oxygen. Even if the internal container is integral to the outer container, they do not have to be made of the same material or have the same physical properties such as strength.

Figure 3A:
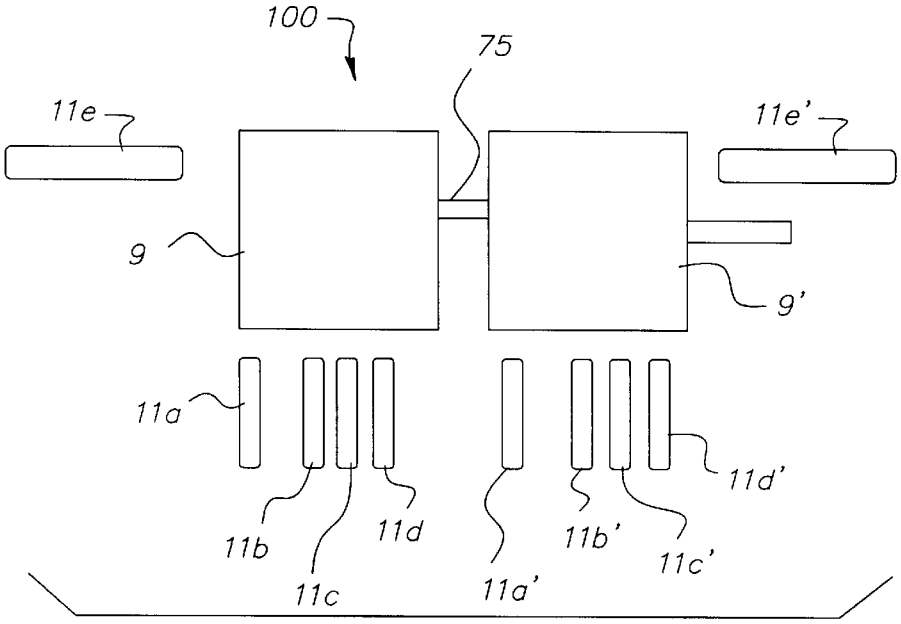
FIGS. 3A–3D schematically illustrate a usage cycle in accordance with the system and the method of providing photoprocessing services of the present invention.

With respect to the system and method of providing photofinishing services of the present invention, reference is made to FIGS. 3A–3D. In the method of the present invention, a designated supplier entity, such as for example, a total service provider or an association of service providers would supply a packaging system to a customer, collect the spent packaging system, and refurbish the spent packaging system for reuse. As shown in FIG. 3A, the designated supplier entity would perform the service of first, fabricating outer and internal containers to form the packaging system. More specifically, as shown in FIG. 3A, the method of providing photoprocessing service can first include the fabrication of outer container 9 and internal containers 11*a*–11*d* in the manner shown in the figures. That is, prior to first use, internal containers 11*a*–11*d* are filled with the appropriate processing solution and assembled within outer container 9. It is noted that within the context of the present invention, the invention is not limited to the use of a single outer container 9. For example, the present invention can be practiced by utilizing a multiple container arrangement and more particularly a tandem packaging system 100 which includes packaging system 7 and a further packaging system 7'. In the example of FIGS. 3A–3D, tandem packaging system 100 includes outer container 9 and a further outer container 9', which includes additional internal containers 11*a*', 11*b*', 11*c*' and 11*d*'. Outer containers 9 and 9' are appropriately connected to each other via, for example, a physical connection 75 such as a rod or brace to form a tandem packaging system 100.

Figures 3B, 3C, 3D:
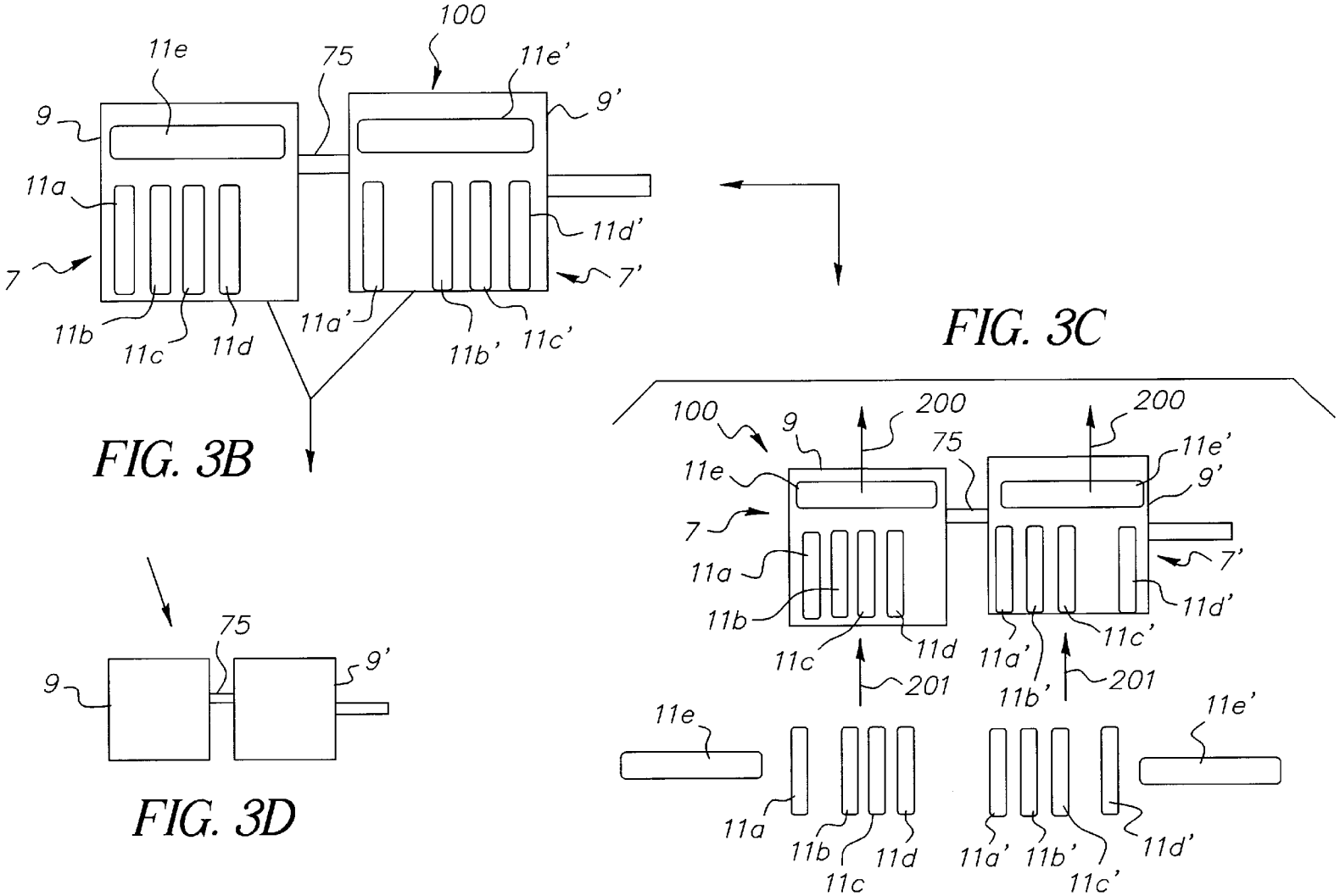

The method of the present invention involves a step (1) filling internal containers 11*a*–11*d* and optionally internal containers 11*a*'–11*d*' for the tandem arrangement with the appropriate processing solution, and inserting internal containers 11*a*–11*d* and optionally internal containers 11*a*'–11*d*' within their respective outer containers 9 and 9' (FIG. 3A); step (2) delivering packaging system 7 or 7' or tandem packaging system 100 containing the solutions to a photoprocessing site and subsequently retrieving the spent system (FIGS. 3B, 3C); step (3) optionally emptying the spent solution collected by the system to either (i) separate the empty containers 11*a*–11*d* and 11*a*'–11*d*' from outer containers 9, 9', (ii) dispose of internal containers 11*a*–11*d*, 11*a*'–11*d*' and reuse outer container 9, or (iii) refurbish internal containers 11*a*–11*d*, 11*a*'–11*d*' for subsequent reuse; step (4) subsequent refilling of refurbished internal containers 11*a*–11*d*, 11*a*'–11*d*' or new internal containers with photoprocessing solution and, optionally, any materials that are required to render photoprocessing waste less hazardous, and assembling (if necessary) internal containers 11*a*–11*d*, 11*a*'–11*d*' and the appropriate refurbished outer container 9, 9'(FIG. 3C); and step (5) disposal of the packaging system(s) when they are no longer functional due to physical damage, wear, leaks, etc. (FIG. 3D). The sequence of steps 2, 3 and 4 can be carried out until the packaging system(s) are no longer functional, in which case step 5 and step 1 are activated to dispose of the non–functional system and create a replacement system.

Therefore, the general steps of the usage cycle as indicated in FIGS. 3A–3D can be defined as follows, a birth or creation step (FIG. 3A) in which filled internal containers 11*a*–11*d*, 11*a*'–11*d*' are inserted in outer container 9, 9', and optionally a waste container 11*e*, 11*e*' is inserted into outer container 9, 9'; a use step in which the packaging system is delivered to a photoprocessing site, the packaging system is fluidly connected to a processor at the processing site, and processing solution is supplied to the processor and optionally, spent solution from the processor is collected in container 11*e*, 11*e*'(FIG. 3B); and a regeneration step in which the spent system is removed from the processing site and optionally the empty internal containers are refurbished and the spent solution container(s) are removed (arrow 200, FIG. 3C) in a manner in which the internal containers can be refurbished for reuse. The refilled internal containers can then be reinserted back into the outer containers (arrow 201, FIG. 3C). As a further option, the internal containers are discarded and the outer container is refurbished for reuse with newly filled internal containers.

The method of refurbishing the outer containers and the internal containers depends on the requirements of the customer and the solution that the internal containers have. For the outer containers, refurbishing may simply be to remove the spent internal containers so that the newly filled internal containers may replaced. Other aspects of refurbishing can include updating the label. Cleaning of the outer containers may be needed if a leak of the internal containers has occurred during the cycle. For internal containers, refurbishing is required only if they are reused. In such an instance, cleaning may or may not be required, depending on the solution that is contained in the respective internal container. Solutions that are critical to the image processing or susceptible to chemical degradation or bio-degradation, would necessitate that the internal containers be cleaned. In other instances, the emptied internal containers may simply be refilled and refurbishing in this instance may be simply updating the labels. The processes involved in refurbishing will also depend on regulatory issues. For instance, if the waste container has silver bearing waste, cleaning of the internal container may be dictated by the local regulations, if the presence of silver will deem it a hazardous material.

After several reuse cycles, physical damage or wear may render the chemical management cartridge to fall below the fitness for reuse specifications and will require that the containers be discarded in some fashion (FIG. 3D). The above FIGS. 3A–3D are generally defined as a usage cycle or use cycle for the packaging system or tandem packaging system in accordance with the present invention. In a preferred feature of system and method of the present invention, the designated supplier entity or association of suppliers would be responsible for all the steps indicated above or at least a majority of the steps described with reference to FIGS. 3A–3D. In this arrangement, the photofinishing site and the user/customer does not have to be concerned with treating chemicals, adding chemicals, delivering chemicals, treating wastes and disposing of waste.

Outer container 9, 9' is preferably made from a durable, rigid material that can withstand the stresses of transportation and use at a photoprocessor site for several usage cycles. It should also have sufficient strength to hold the weight of the solution it contains. Each outer container 9, 9' must hold at least one internal container 11*a*–11*d*, 11*a*'–11*d*' for a processing solution or a waste solution. The total number of internal containers 11*a*–11*d*, 11*a*'–11*d*' per outer container 9, 9' is determined by the final weight of outer container 9, 9' which contains the filled internal containers. If container 9, 9' is to be handled manually, the weight of packaging system 7, 7' or tandem packaging system 100 should preferably not exceed 50 lbs. If the system is to support a high volume processing operation, each outer container 9, 9' may only contain one internal container 11*a*–11*d*, 11*a*'–11*d*'. However, if the photoprocessing operation volume is small, all the required processing solutions, such as but not limited to developer, stop, bleach, fix, rinse for color negative processes, reversal processes, paper processes or black and white processes may be contained in a single container. When not all of the desired solutions can be contained in a single outer container 9, one can use an arrangement such as packaging system 100 which is essentially a series of several outer containers as illustrated in FIGS. 3A–3D. Each outer container 9, 9' contains one solution or more than one solution. In photoprocessing operations which are substantially large, certain solutions with high volumes, like the rinse solution, may not be contained in a single outer container. In such an operation the high volume solutions may be divided up into more than one outer container and the solution may be retrieved sequentially or simultaneously from the multiple containers.

In a design or arrangement where a series of different solutions are linked together to support a photoprocessing operation, the ratio of the volumes of the different photoprocessing solutions in container 9 or the series of containers 9, 9' (tandem packaging system 100) should be similar to or close to the respective ratios of utilization in the photoprocessing operation. This will permit all the containers 11*a*–11*d* and optionally container 11*a*'–11*d*' to empty at the same time, thereby minimizing the waste of unused solutions. As previously described, and using container 9 as an example, internal containers 11*a*–11*d* can be an integral part of outer container 9. For example, internal containers 11*a*–11*d* may be in the form of compartments molded within rigid outer container 9 with appropriate closures. As also previously described, in a further embodiment, containers 11*a*–11*d* may be separate from outer container 9. In this latter embodiment, outer container 9 as well as internal containers 11*a*–11*d* would have provisions to mount or load the internal containers. Also in this embodiment, the internal containers can be rigid or may be flexible in a form of a pouch or bag. The material of construction of the internal containers is such that it is compatible with solutions filling the internal container.

Spent solution container 11*e*, 11*e*' can be essentially similar to the other internal containers 11*a*–11*d*, 11*a*'–11*d*' except that they reach the photoprocessor empty and leave full. Spent solution container 11*e*, 11*e*' may also be filled partially with materials to treat photoprocessing spent solution as previously described. For example, it can contain a silver recovery agent to convert the silver from soluble to insoluble, as disclosed in copending application docket no. 82053. The assembled container (packaging system 7 or tandem packaging system 100) will also have all the necessary valves and/or quick release connections for connection to the processor as shown in FIG. 2.

Therefore, during use, photoprocessing solutions are dispensed from internal containers 11*a*–11*d* and/or 11*a*'–11*d*' to the photoprocessing machine as previously described and shown in FIG. 2. In one embodiment, internal containers 11*a*–11*d* and/or 11*a*'–11*d*' contain replenishment chemicals which are dispensed as needed (continuously or at discrete intervals). In further photoprocessing methods, solutions can be used and discharged for every unit of imaging element processed. In this further method, discrete volumes of photoprocessing solutions are dispensed upon demand. By selecting the ratio of the volumes of the solutions in internal containers 11*a*–11*d* and/or 11*a*'–11*d*' to be equal to or close to the ratio of the dispensing volumes of the same solution, internal containers 11*a*–11*d* and/or 11*a*'–11*d*' will become empty together. In this manner, outer container 9, 9' or packaging system 100 can be replaced with one that has all of the internal containers full with processing solutions. In the embodiment where the waste or spent solution is collected in container 11*e* and/or 11*e*', the volume of container 11*e* and/or 11*e*' should equal the volume of waste or spent solution generated, which may or may not be equal to the total volume of the solutions dispensed. It is also possible that containers 11*e* and/or 11*e*' will contain only the partial waste, for example, it may collect only silver bearing waste after a fixing step.

In the method of the present invention, after use, spent outer container 9, 9' or tandem packaging system 100 can be regenerated at the point of use or transported from the point of use (photoprocessing site) to a regeneration or refurbishing site. During regeneration the empty internal containers 11*a*–11*d*, 11*a*'–11*d*' can be either refurbished for reuse or separated from outer containers 9, 9' to be discarded. If they are to be discarded, they could optionally be cleaned to remove any residual processing solution, in order to comply with local regulations. In the embodiment where spent solution is collected in container 11*e* and/or 11*e*', container 11*e* and/or 11*e*' is emptied and refurbished for reuse or discarded. The spent solution can be appropriately treated and disposed at the regeneration site or transported to a specialized waste treatment facility. For the purpose of this invention, waste or spent solution treatment refers to any operation that can extract economic value from the waste (such as silver recovery), or to render the waste less hazardous to comply with local regulations.

In order to make the system ready for reuse, processing solutions are filled into the internal containers. In the case where internal containers 11*a*–11*d* and/or 11*a*'–11*d*' are integral with outer container 9 and/or 9', the operation is simply to fill the solutions into their respective internal compartments. In the embodiment where internal containers 11*a*–11*d* and/or 11*a*'–11*d*' are separable from outer container 9, 9', the processing solutions can be filled into the internal containers which are then assembled with the outer containers, or an assembly of empty internal containers into outer containers can be done prior to the internal containers being filled. In this embodiment, the internal containers have either been refurbished for refilling if they are being reused, or are new if the previous internal containers were single-use containers. During the assembly step, all necessary plumbing and fluid connections are also put in place to permit the supply of the solution to the photoprocessing machine.

In another embodiment of the invention, it might be preferable to keep certain critical solutions, such as developer, within a single-use internal container, while other solutions such as the rinse solution container can be contained in a reusable internal container. Such a solution arrangement could provide better process control over the more critical steps in photoprocessing, yet still maintain the advantages set forth in this invention.

Depending on the economic value, the regeneration or refurbishing and the assembly of the filled internal containers and outer containers can be performed by a designated supplier entity at several sites called distributors. Whereas, accurate and capital intensive operation of filling the internal containers can be accomplished by a designated supplier entity at a centralized site which can ship the filled containers to the distributors. A modification of this embodiment is to have critical solutions (from toxicity, hazard and cost standpoints) accomplished at a central location, whereas the remaining internal containers are filled at the distributor sites.

After a certain number of usage cycles, the components (i.e. containers of the packaging system that are reused) can get damaged or worn to make the system otherwise unfit for use. As indicated above, based on fitness for use specifications, the individual containers or the entire system can be discarded and replaced with a new one as previously described. Any containers of the packaging system that come into contact with processing solutions can be suitably cleaned or treated prior to disposal.

Therefore, the present invention provides for a method of providing photoprocessing services in which a packaging system in the form of an outer container containing individual internal containers or compartments having processing solutions therein can be used and reused. After all the solutions are emptied, the waste or spent solutions can be disposed of appropriately and the containers refurbished and/or cleaned. Fresh solutions can then be filled into the refurbished and/or cleaned internal containers, the filled internal containers can be placed in the refurbished and/or cleaned outer container, and the entire packaging system can be delivered to or transported back to same photoprocessing site or a further photoprocessing site for reuse. These services are preferably performed by a designated supplier entity.

The invention has been described in detail with particular reference to certain preferred embodiments thereof, but it will be understood that variations and modifications can be effected within the spirit and scope of the invention.

What is claimed is:

1. A method of providing photoprocessing services, the method comprising:

(a) filling at least one internal container with a processing solution, wherein a volume of processing solution in said internal container is based on a rate of usage of the processing solution at a processing site;

(b) placing the at least one internal container having the processing solution therein into an outer container;

(c) transporting the outer container having the at least one filled internal container therein to the processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied;

(d) removing the outer container having the at least one emptied internal container therein from the processing machine; and (e) preparing at least one of the internal and outer containers for reuse;

wherein each of said steps (a) to (e) are performed by a designated supplier entity.

2. A method according to claim 1, wherein said preparing step (e) comprises the step of refurbishing both the internal and outer containers; and after said refurbishing step, said method further comprises:

(f) refilling the internal container with processing solution;

(g) placing the refilled internal container into the outer container, and (h) transporting the outer container having the refilled internal container therein to the processing site for reuse on the processing machine or to a further processing site for reuse on a further processing machine at the further processing site wherein each of said steps (f) to (h) are performed by the designated supplier entity.

3. A method according to claim 2, further comprising:

(i) disposing of the outer and internal containers after multiple refurbishing and reuse of the internal and outer containers, wherein said step (i) is performed by the designated supplier entity.

4. A method according to claim 1, wherein said preparing step (e) comprises the steps of refurbishing only said outer container and disposing of said internal container; and after said refurbishing and disposing steps, the method comprises:

(f) refilling a further internal container with processing solution;

(g) placing the refilled further internal container into the outer container; and (h) transporting the outer container having the refilled further internal container therein to the processing site for reuse on the processing machine or to a further processing site for reuse on a further processing machine at the further processing site;

wherein each of said steps (f) to (h) are performed by the designated supplier entity.

5. A method according to claim 4, further comprising:

(i) disposing of the outer container after multiple refurbishing and reuse.

6. A method according to claim 1, wherein said outer container is a rigid outer container.

7. A method of providing photoprocessing services, the method comprising:

filling a plurality of internal containers with different processing solutions;

placing a waste container and the plurality of internal containers having the processing solutions therein into an outer container;

transporting the outer container having the waste container and the plurality of filled internal containers therein to a processing site for use at the processing site, wherein during use, the outer container with the plurality of filled internal containers therein is fluidly connected to a processing machine at the processing site, such that the processing solutions are supplied from the plurality of filled internal containers to the processing machine until the internal containers are emptied and waste processing solution from the plurality of internal containers and the processing machine is collected in the waste container;

removing the outer container having the waste container filled with waste solution and the plurality of emptied internal containers therein from the processing machine; and reusing at least the outer container.

8. A method according to claim 7, further comprising:

providing a silver removal device in the waste container for reducing an amount of silver in the collected waste solution.

9. A method according to claim 7, further comprising:

disposing of the internal container, the outer container and the waste container after multiple reuse and refurbishing.

10. A method according to claim 7, wherein said outer container is a rigid outer container.

11. A method of providing photoprocessing services, the method comprising:

(a) filling at least one internal compartment of a container with a processing solution, said at least one internal compartment being integral with said container;

(b) transporting the container having the at least one filled internal compartment to a processing site for use at the processing site, wherein during use, the container with the at least one filled internal compartment is fluidly connected to a processing machine at the processing site, such that the processing solution is supplied from the at least one filled internal compartment to the processing machine until the at least one internal compartment is emptied;

(c) removing the container having the at least one emptied internal compartment from the processing machine; and (d) refurbishing the container and the internal compartment;

wherein said steps (a) to (d) are performed by a designated supplier entity.

12. A method according to claim 11, wherein after said refurbishing step (d), said method further comprises:

(e) refilling the internal compartment with processing solution; and (f) transporting the container having the refilled internal compartment to the processing site for reuse on the processing machine or to a further processing site for reuse on a further processing machine at the further processing site;

wherein said steps (e) and (f) are performed by the designated supplier entity.

13. A method according to claim 12, further comprising:

(g) disposing of the container after multiple refurbishing and reuse, wherein said step (g) is performed by the designated supplier entity.

14. A method according to claim 11, wherein said container is a rigid container.

15. A method of providing photoprocessing services, the method comprising:

filling a first internal compartment of a container with a processing solution, said container having a second internal compartment for waste solution, said first and second internal compartments being integral with said container;

transporting the container having the filled first internal compartment and the second internal compartment for waste solution to a processing site for use at the processing site, wherein during use, the container is fluidly connected with a processing machine at the processing site, such that the processing solution is supplied from the first filled internal compartment to the processing machine until the first filled internal compartment is emptied, and waste solution from the processing machine is continuously or periodically collected in the second internal compartment for waste solution;

removing the container having the emptied first internal compartment and the second internal compartment filled with waste processing solution therein from the processing machine; and refurbishing the container and the first and second internal compartments for reuse.

16. A method according to claim 15, wherein after said refurbishing step, said method further comprises:

refilling the first internal compartment of the container with processing solution; and transporting the container to the processing site for reuse on the processing machine or to a further processing site for reuse on a further processing machine at the further processing site.

17. A method according to claim 15, further comprising:

providing a silver removal device in the second internal compartment for reducing an amount of silver in the collected waste solution.

18. A method according to claim 16, further comprising:

disposing of the container after multiple reuse and refurbishing.

19. A method according to claim 15, wherein said container is a rigid container.

20. A method of providing photoprocessing services, wherein a single service supplier performs the steps of:

supplying a processing solution supply packaging system having different processing solutions therein to a photofinishing site for use in a stand-alone processing solutions in the processing solution supply packaging system is based on ratios of utilization of the different processing solutions at said processor to permit all of the supplied processing solutions to be exhausted at approximately the same time;

removing the processing solution packaging system and waste processing solution resulting from the use of the processing solution supply packaging system from the photofinishing site; and refurbishing the processing solution packaging system for reuse at the photofinishing site or a further photofinishing site.

21. A photoprocessing method comprising:

filling at least one internal container with a processing solution; placing the at least one internal container having the processing solution therein into an outer container;

transporting the outer container having the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied;

removing the outer container having the at least one emptied internal container therein from the processing machine; and reusing at least the outer container;

wherein said reusing step comprises refurbishing and reusing both the internal container and the outer container, such that after said refurbishing of the internal and outer containers, said method further comprises:

refilling the internal container with processing solution;

placing the refilled internal container into the outer container; and transporting the outer container having the refilled internal container therein to the processing site for reuse on the processing machine or to a further processing site for reuse on a further processing machine at the further processing site.

22. A method according to claim 21, further comprising:

disposing of the outer and internal containers after multiple refurbishing and reuse of the internal and outer containers.

23. A method according to claim 21, wherein said reusing step comprises reusing only said outer container and disposing of said internal container, and the method further comprising:

refilling a further internal container with processing solution;

placing the refilled further internal container into the outer container; and transporting the outer container having the refilled further internal container therein to the processing site for reuse on the processing machine or to a further processing site for reuse on a further processing machine at the further processing site.

24. A method according to claim 23, further comprising:

disposing of the outer container after multiple refurbishing and reuse.

25. A method according to claim 21, wherein said outer container is a rigid outer container.

26. A method of providing photoprocessing services, wherein a single service supplier performs the steps of:

supplying a processing solution packaging system having processing solution therein to a photofinishing site for use in a processor at the photofinishing site, said packaging system comprising at least two rigid outer containers each having at least one internal container filled with processing solution therein, wherein an amount of solution in each of the internal containers is such that the solutions in the internal containers will be completely utilized during use in the processor;

removing the processing solution packaging system and waste processing solution resulting from the use of the processing solution packaging system from the photofinishing site; and refurbishing the processing solution packaging system for reuse at the photofinishing site or at a further photofinishing site.

27. A method according to claim 26, wherein said refurbishing step comprises reusing the at least two outer rigid containers and discarding the internal containers.

28. A method according to claim 26, wherein said refurbishing step comprises refurbishing the internal containers.

29. A method according to claim 26, wherein said refurbishing step comprises refurbishing said at least two rigid outer containers and said internal containers.

30. A method according to claim 26, wherein at least one of said rigid outer containers comprises a further internal container for receiving waste solution from the processor.

31. A reusable processing solution packaging system comprising:

at least two rigid outer containers, each one of said at least two rigid outer containers having at least one internal container filled with processing solution therein, wherein an amount of solution in each of the internal containers is such that the solutions in the internal containers will be completely utilized during use in a processor.

32. A reusable processing solution packaging system according to claim 31, wherein at least one of said internal containers is adapted to collect waste solution from the processor.

33. A photoprocessing method comprising:

filling a plurality of internal containers with a processing solution;

placing the plurality of internal containers having the processing solution therein into an outer container;

transporting the outer container having the filled plurality of internal containers therein to a processing site for use at the processing site, wherein during use, the outer container with the plurality of filled internal containers therein is fluidly connected to a processing machine at the processing site, such that the processing solution is supplied from the plurality of filled internal containers to the processing machine until the plurality of filled internal containers are emptied;

removing the outer container having the plurality of emptied internal containers therein from the processing machine; and cleaning selected ones of said plurality of internal containers based on the type of solution carried in the internal containers.

34. A method of providing photoprocessing services, the method comprising:

filling at least one internal container with a processing solution;

placing a waste container and the at least one internal container having the processing solution therein into an outer container;

providing a silver removal device in the waste container for reducing an amount of silver in waste solution collected in the waste container;

transporting the outer container having the waste container and the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied and waste processing solution from the processing machine is collected in the waste container;

removing the outer container having the waste container filled with waste solution and the at least one emptied internal container therein from the processing machine, wherein the amount of silver in the waste solution is reduced by the silver removal device; and reusing at least the outer container.

35. A method of providing photoprocessing services, the method comprising the steps of:

receiving a processing solution supply packaging system comprising an outer container and at least one internal container therein, said at least one internal container being empty as a result of prior usage at a photoprocessing site;

refurbishing at least one of the internal container and the outer container for reuse at a selected photoprocessing site;

refilling the at least one internal container in a manner in which a volume of processing solution provided in said internal container is based on a rate of utilization of processing solution at the selected photoprocessing site; and placing the refilled internal container into the outer container.

36. A method of providing photoprocessing services, the method comprising the steps of:

filling at least one solution supply container with processing solution;

placing a silver removal device into a waste container; and placing the filled solution supply container and the waste container having the silver removal device therein into an outer container for use at a photoprocessing site.

37. A method of providing photoprocessing services, the method comprising the steps of:

receiving a processing solution supply packaging system comprising an outer container and at least one internal container therein, at least said internal container being made of a material which has a low permeability to oxygen;

refurbishing at least one of the internal container and the outer container for use at a selected photoprocessing site;

filling the at least one internal container with processing solution; and placing the filled internal container into the outer container.

38. A method of providing photoprocessing services, the method comprising:

(a) filling at least one internal container with a processing solution, said at least one internal container being made of a material that has a low permeability o oxygen;

(b) placing the at least one internal container having the processing solution therein into an outer container;

(c) transporting the outer container having the at least one filled internal container therein to a processing site for use at the processing site, wherein during use, the outer container with the at least one filled internal container therein is fluidly connected to a processing machine at the processing site, such that the processing solution is supplied from the at least one filled internal container to the processing machine until the at least one internal container is emptied;

(d) removing the outer container having the at least one emptied internal container therein from the processing machine; and (e) preparing at least one of the internal and outer containers for reuse.

* * * * *

UNITED STATES PATENT AND TRADEMARK OFFICE

CERTIFICATE OF CORRECTION

PATENT NO. : 6,520,693 B2
DATED : February 18, 2003
INVENTOR(S) : Lobo et al.

It is certified that error appears in the above-identified patent and that said Letters Patent is hereby corrected as shown below:

Column 14,
Line 44, after "stand-alone" insert -- processor at the photofinishing site, wherein a ratio of volumes of different --

Signed and Sealed this

Twenty-eighth Day of June, 2005

JON W. DUDAS
*Director of the United States Patent and Trademark Office*